US008882019B2

(12) United States Patent
Bourgeoisat et al.

(10) Patent No.: US 8,882,019 B2
(45) Date of Patent: Nov. 11, 2014

(54) METHOD FOR THE MANUFACTURE OF A WOUND PACKAGE WITH SEPARATE STRANDS

(75) Inventors: Herve Bourgeoisat, Novalaise (FR); Jean-Michel Cogniaux, La Molle Servolex (FR)

(73) Assignee: OCV Intellectual Capital, LLC, Toledo, OH (US)

( * ) Notice: Subject to any disclaimer, the term of this patent is extended or adjusted under 35 U.S.C. 154(b) by 1776 days.

(21) Appl. No.: 12/296,559

(22) PCT Filed: Apr. 4, 2007

(86) PCT No.: PCT/FR2007/051067

§ 371 (c)(1), (2), (4) Date: Nov. 29, 2011

(87) PCT Pub. No.: WO2007/116181

PCT Pub. Date: Oct. 18, 2007

(65) Prior Publication Data

US 2012/0111983 A1 May 10, 2012

(30) Foreign Application Priority Data

Apr. 10, 2006 (FR) ..... 06 51291

(51) Int. Cl.
*B65H 54/02* (2006.01)

(Continued)

(52) U.S. Cl.
CPC ..... *B65H 54/026* (2013.01); *B65H 54/36* (2013.01); *B65H 2701/3122* (2013.01);

(Continued)

(58) Field of Classification Search
USPC ..... 242/472.8–473.3, 474.4–474.7
See application file for complete search history.

(56) References Cited

U.S. PATENT DOCUMENTS 2,930,102 A 3/1960 Hitchin
3,032,813 A 5/1962 Stalego (Continued)

FOREIGN PATENT DOCUMENTS

BE 640 075 5/1964
CN 1092016 9/1994

(Continued)

OTHER PUBLICATIONS

Notice of Allowance from U.S. Appl. No. 12/266,592 dated Jan. 6, 2012.

(Continued)

*Primary Examiner* — William E Dondero
(74) *Attorney, Agent, or Firm* — Calfee, Halter & Griswold LLP

(57) ABSTRACT

Method for the manufacture of wound packages comprising a plurality of assembled strands, characterized in that one separates the strands coming from a spinneret into at least 2 blankets, in which each one of the blankets is wound on the same wound package with the help of a traveler, said wound package supported by one of the spindles, one proceeds to start the movement of the circular pirn battery in such a way as to switch one of the spindles from its spooling phase to its rest phase, during this transition phase between the spindles, one proceeds to a separation of the rovings traveling from the spinneret to the surface of said wound package with the help of a separation device, one brings the cursor closer to the surface of the wound package and the latter then intercepts the trajectory of each one of the separated rovings in such a way as to enclose each one of the rovings within said traveler, and one positions the separation device in its second position.

10 Claims, 2 Drawing Sheets

Figure 1:
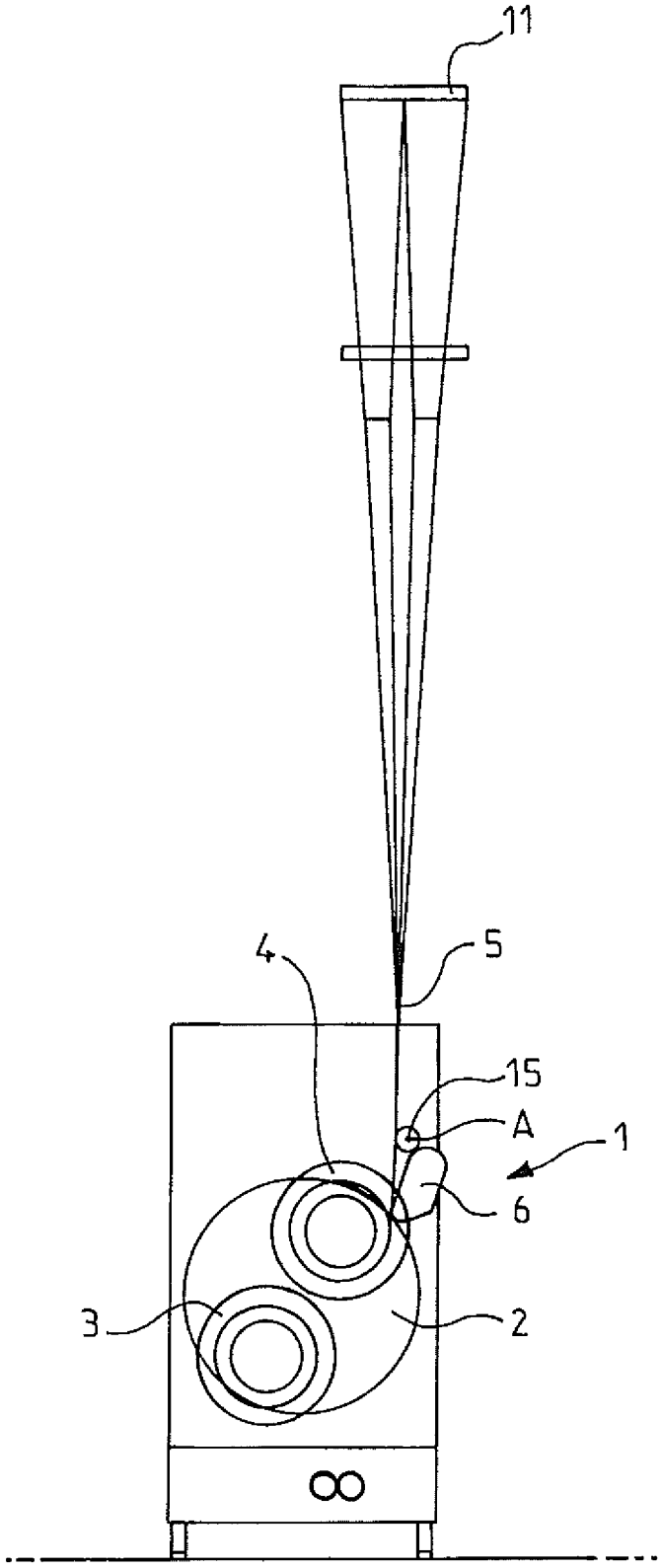

(51) Int. Cl.

| | |
|---|---|
| ***B65H 67/048*** | (2006.01) |
| ***B65H 54/36*** | (2006.01) |
| ***B65H 55/00*** | (2006.01) |
| ***B65H 54/28*** | (2006.01) |
| ***B65H 57/16*** | (2006.01) |
| ***B65H 57/00*** | (2006.01) |

(52) U.S. Cl.

CPC ..... *B65H 55/005* (2013.01); *B65H 2701/3132* (2013.01); *B65H 54/2812* (2013.01); *B65H 57/16* (2013.01); *B65H 67/048* (2013.01); *B65H 57/003* (2013.01); *B65H 57/006* (2013.01)

USPC ..... 242/472.8; 242/474.5; 242/474.7

(56) References Cited

U.S. PATENT DOCUMENTS

| | | | |
|---|---|---|---|
| 3,072,518 | A | 1/1963 | White |
| 3,091,018 | A | 5/1963 | Rees |
| 3,134,704 | A | 5/1964 | Modigliani |
| 3,269,818 | A | 8/1966 | Tiede |
| 3,292,871 | A | 12/1966 | Smith et al. |
| 3,844,497 | A | 10/1974 | Harrill |
| 3,939,639 | A | 2/1976 | Ellegast |
| 3,955,952 | A | 5/1976 | Drummond |
| 4,230,284 | A | 10/1980 | Cunningham |
| 4,342,579 | A | 8/1982 | Sanders |
| 4,492,662 | A | 1/1985 | Larrive |
| 4,762,750 | A | 8/1988 | Girgis et al. |
| 4,774,042 | A | 9/1988 | Schippers |
| 4,865,085 | A | 9/1989 | Ghiardao |
| 5,011,523 | A | 4/1991 | Roncato et al. |
| 5,156,347 | A | 10/1992 | Gay |
| 5,316,561 | A | 5/1994 | Roncato |
| 5,422,180 | A | 6/1995 | Lukhard et al. |
| 5,425,796 | A | 6/1995 | Loubinoux et al. |
| 5,454,846 | A | 10/1995 | Roncato et al. |
| 5,558,825 | A | 9/1996 | Ueda et al. |
| 5,582,843 | A | 12/1996 | Sellars |
| 5,626,643 | A | 5/1997 | Woodside et al. |
| 5,744,089 | A | 4/1998 | Woodside et al. |
| 5,811,480 | A | 9/1998 | Kirchmeyer et al. |
| 6,025,073 | A | 2/2000 | Piret |
| 6,027,680 | A | 2/2000 | Woodside et al. |
| 6,074,590 | A | 6/2000 | Gownder |
| 6,109,066 | A | 8/2000 | Loubinoux |
| 6,183,676 | B1 | 2/2001 | Gonthier |
| 6,190,768 | B1 | 2/2001 | Turley et al. |
| 6,270,897 | B1 | 8/2001 | Flautt et al. |
| 6,440,558 | B2 | 8/2002 | Klaus et al. |
| 6,482,400 | B1 | 11/2002 | Collin |
| 6,514,612 | B1 | 2/2003 | Moreau et al. |
| 7,351,473 | B2 | 4/2008 | Gonthier |
| 7,416,782 | B2 | 8/2008 | Renaudin et al. |
| 7,465,418 | B2 | 12/2008 | Boissonnat et al. |
| 8,137,094 | B2 | 3/2012 | Boissonnat et al. |
| 8,470,218 | B2 | 6/2013 | Loubinoux |
| 2002/0164192 | A1 | 11/2002 | Gueret |
| 2005/0060980 | A1 | 3/2005 | Howell et al. |
| 2006/0234028 | A1 | 10/2006 | Pardo |
| 2008/0299856 | A1 | 12/2008 | Loubinoux et al. |
| 2009/0126332 | A1 | 5/2009 | Boissonnat |
| 2010/0230851 | A1 | 9/2010 | Loubinoux et al. |

FOREIGN PATENT DOCUMENTS

| | | |
|---|---|---|
| CN | 1107909 | 9/1995 |
| CN | 1112513 | 11/1995 |
| CN | 1200809 | 12/1998 |
| CN | 1220642 | 6/1999 |
| CN | 1479811 | 3/2004 |
| DE | 3617248 | 3/1987 |
| EP | 0 117415 | 9/1984 |
| EP | 199059 | 10/1986 |
| EP | 211748 | 2/1987 |
| EP | 299506 | 1/1989 |
| EP | 367661 | 5/1990 |
| EP | 505275 | 9/1992 |
| EP | 599695 | 6/1994 |
| EP | 616055 | 9/1994 |
| EP | 610147 | 9/1995 |
| FR | 1303213 | 9/1962 |
| FR | 2 140 443 | 1/1973 |
| FR | 2232620 | 2/1976 |
| FR | 2698038 | 5/1994 |
| JP | 55-16852 | 2/1980 |
| JP | 55-016852 | 2/1980 |
| JP | 58-031111 | 2/1983 |
| JP | 58-41910 | 3/1983 |
| JP | 58-60032 | 4/1983 |
| JP | 2-70841 | 3/1990 |
| JP | 2-160907 | 6/1990 |
| JP | 02-243469 | 9/1990 |
| JP | 2-243469 | 9/1990 |
| JP | 3-059038 | 3/1991 |
| JP | 3-270612 | 12/1991 |
| JP | 4-222246 | 8/1992 |
| JP | 5-207621 | 8/1993 |
| JP | 7-3558 | 1/1994 |
| JP | 6-220731 | 8/1994 |
| JP | 6-294795 | 10/1994 |
| JP | 7-96248 | 4/1995 |
| NO | 174635 | 4/1990 |
| NO | 175683 | 9/1992 |
| WO | 93/06055 | 4/1993 |
| WO | 96/10660 | 4/1996 |
| WO | 96/40596 | 12/1996 |
| WO | 97/10101 | 3/1997 |
| WO | 98/01751 | 1/1998 |
| WO | 00/26155 | 5/2000 |
| WO | 02/28948 | 4/2002 |
| WO | 02/31231 | 4/2002 |
| WO | 02/31235 | 4/2002 |
| WO | 2006/54025 | 5/2006 |
| WO | 2007/113431 | 10/2007 |
| WO | 2007/116181 | 10/2007 |

OTHER PUBLICATIONS

Office action from Chinese Application No. 200780018736.X dated Jan. 11, 2012.

Office action from Chinese Application No. 200780018736.X dated May 16, 2012 along with English translation of relevant portions of action.

International Search Report from PCT/FR97/01184 dated Nov. 28, 1997.

International Search Report and Written Opinion from PCT/FR01/02979 dated Dec. 6, 2001.

International Preliminary Examination Report from PCT/FR01/02979 dated Jan. 21, 2004.

International Search Report and Written Opinion from PCT/FR05/50960 dated Apr. 7, 2006.

International Search Report and Written Opinion from PCT/FR07/51067 dated Aug. 17, 2007.

International Search Report and Written Opinion from PCT/FR07/50991 dated Sep. 17, 2007.

Office action from U.S. Appl. No. 08/152,554 dated Jun. 1, 1994.

Office action from U.S. Appl. No. 08/152,554 dated Nov. 15, 1994.

Notice of Allowance from U.S. Appl. No. 08/152,554 dated Mar. 10, 1995.

Office action from U.S. Appl. No. 09/029,606 dated Jan. 24, 2000.

Notice of Allowance from U.S. Appl. No. 09/029,606 dated May 3, 2000.

Office action from U.S. Appl. No. 10/398,509 dated Jun. 29, 2005.

Office action from U.S. Appl. No. 10/398,509 dated Dec. 9, 2005.

Office action from U.S. Appl. No. 10/398,509 dated May 2, 2006.

Advisory Action from U.S. Appl. No. 10/398,509 dated Jul. 10, 2006.

Office action from U.S. Appl. No. 10/398,509 dated Dec. 12, 2006.

Office action from U.S. Appl. No. 10/398,509 dated May 22, 2007.

(56) References Cited

OTHER PUBLICATIONS

Office action from U.S. Appl. No. 10/398,509 dated Oct. 24, 2007.
Office action from U.S. Appl. No. 10/398,509 dated Jun. 4, 2008.
Notice of Allowance from U.S. Appl. No. 10/398,509 dated Aug. 11, 2008.
Office action from U.S. Appl. No. 11/719,455 dated Jun. 4, 2010.
Office action from U.S. Appl. No. 11/719,455 dated Dec. 8, 2010.
Office action from U.S. Appl. No. 12/266,592 dated Jun. 24, 2010.
Notice of Allowance from U.S. Appl. No. 12/266,592 dated Dec. 10, 2010.
Notice of Allowance from U.S. Appl. No. 12/266,592 dated Apr. 1, 2011.
Office action from U.S. Appl. No. 12/294,965 dated Sep. 12, 2011.
Office action from Australian Application No. 50447/93 dated Aug. 2, 1995.
Office action from Australian Application No. 50447/93 dated Aug. 19, 1996.
Office action from Canadian Application No. 2,103,313 dated Jun. 9, 2003.
Office action from Canadian Application No. 2,425,222 dated Feb. 3, 2009.
Office action from Chinese Application No. 93114244.X dated Mar. 26, 1998.
Office action from Chinese Application No. 97191223.8 dated May 10, 2002.
Office action from Chinese Application No. 01820406.6 dated Jul. 18, 2006.
Office action from Chinese Application No. 01820406.6 dated Nov. 16, 2006.
Office action from Chinese Application No. 01820406.6 dated May 31, 2007.
Office action from Chinese Application No. 200580046779.X dated Sep. 4, 2009.
Office action from Czech Republic Application No. 2490/93 dated May 20, 1997.
Office action from Czech Republic Application No. 2490/93 dated Nov. 1997.
Search Report from EP Application No. 93402783 dated Feb. 17, 1994.
Communication from EP Application No. 97931851.6 dated Oct. 1, 2001.
Communication from EP Application No. 01972213.1 dated Jan. 21, 2004.
Communication from EP Application No. 05819176.8 dated Mar. 19, 2010.
Communication from EP Application No. 07731870.7 dated Apr. 22, 2009.
Communication from EP Application No. 07731804.6 dated Feb. 19, 2009.
Communication from EP Application No. 07731804.6 dated Jun. 29, 2010.
Search Report from French Application No. 0651115 dated Dec. 11, 2006.
Search Report from FR Application No. 00 12990 dated Jan. 10, 2003.
Search Report from FR Application No. 656,366 dated Jul. 4, 2005.
Search report from FR Application No. 678,022 dated Dec. 14, 2006.
Office action from Hungarian Application No. 9303276 dated Mar. 18, 1997.
Office action from Hungarian Application No. 9303276 dated Apr. 6, 1998.
Office action from Indian Application No. 697/Cal/93 dated Jul. 25, 1996.
Office action from Indian Application No. 1239/Cal/97 dated Mar. 3, 2003.
Office action from Indian Application No. 1239/Cal/97 dated Jan. 14, 2004.
Office action from Indian Application No. 401/KOLNP/2003 dated Oct. 5, 2007.
Office action from Japanese Application No. 5-290935 dated May 8, 2001.
Office action from Japanese Application No. 10-504855 dtaed Feb. 7, 2006.
Office action from Japanese Application No. 10-504855 dated Sep. 19, 2006.
Office action from Japanese Application No. 2002-534596 dated Mar. 29, 2011.
Office action from Korean Application No. 10-1998-0701757 dated Feb. 2, 2005.
Office action from Korean Application No. 10-2003-7004997 dated Apr. 17, 2007.
Office action from Mexican Application No. 93.07210 dated Jan. 26, 1998.
Office action from Norwegian Application No. P934036 dated Nov. 1, 1995.
Office action from Norwegian Application No. P934036 dated Jul. 30, 1996.
Office action from Norwegian Application No. 934036 dated Oct. 25, 1996.
Office action from Norwegian Application No. 934036 dated Jan. 31, 1997.
Office action from Norwegian Application No. 934036 dated Sep. 3, 1997.
Office action from Polish Application No. 301,085 dated Nov. 22, 1996.
Office action from Russian Application No. 93051360 dated Dec. 20, 1997.
Office action from Russian Application No. 98106476 dated Jun. 20, 2001.
Office action from Russian Application No. 2003113213 dated 2005.
Office action from Slovakia Application No. PV 0317-98 dated Oct. 12, 2004.
Office action from Taiwanese Application No. 86116776 dated Dec. 22, 1998.
Anter Laboratories, Inc. Linear Thermal Expansion Data Sheet 1988.
Notice of Allowance from U.S. Appl. No. 12/266,592 dated Oct. 6, 2011.
Office action from Russian Application No. 2008138756 dated Oct. 7, 2011.
Office action from Taiwanese Application No. 096108785 dated Jul. 9, 2013.
Notice of Allowance from U.S. Appl. No. 12/294,965 dated Apr. 16, 2013.
Office action from Chinese Application No. 200780018736.X dated Jun. 16, 2011.
Office action from Indian Application No. 4332/KOLNP/2008 dated Aug. 26, 2013.
Office action from Canadian Application No. 2,647,962 dated Aug. 19, 2013.
Office action from Korean Application No. 2008-7026586 dated May 16, 2013.
Office action from Chinese Application No. 201210580936.7 dated May 29, 2014.

METHOD FOR THE MANUFACTURE OF A WOUND PACKAGE WITH SEPARATE STRANDS

The present invention relates to a method for the manufacture of wound packages comprising a plurality of strands wound in parallel that can be reeled off in the form of a single assembled roving, strands for industrial use, notably based on glass or on thermoplastic polymer. According to another aspect of the invention, it also relates to the wound package so obtained, as well as to the device that makes it possible to carry out this method.

In the context of the manufacture of glass strands for reinforcement, the manufacture of an assembled roving is the result of a complex industrial process that consists in obtaining strands from thin jets of molten glass flowing through orifices of spinnerets. These thin jets are drawn into the form of continuous filaments, and then these filaments are combined to base strands, strands which are then generally connected in the form of cakes intended for internal use because they are difficult to transport. The cakes are then positioned on the creels that feed a bobbin winder on which the cylindrical ball of assembled roving forms. The products obtained are not free of defects, such as corrugation or loops originating from differences in the tension of the base strands.

The manufacture of a multifilament roving leads in a single operation and directly under the spinneret (direct roving) to the production of cylindrical bobbins consisting of a single large strand whose threads (in the sense of continuous filaments) are correctly under equal tension.

According to the invention, the bobbins are also in the form of wound packages with straight sides or in the form of cylindrical wound packages, generally referred to as "roving" or "ball" as a function of their final destination.

The preparation in the form of a bobbin is carried out with the bobbin winders which, as their name indicates, have the function of winding the glass strands that have been sized beforehand at very high speed (approximately 10-50 m per second).

These bobbin winders ensure the drawing and the winding of these filaments, and the operating parameters of these bobbin winders determine, together with those of the spinneret, the dimensional characteristics of the strand, notably, for example, in tex (tex being the gram weight of 1000 m fibers or strands).

Usually, a bobbin winder is placed approximately under a spinneret, from which one or more rovings of strands, gathered into one point or several points, descend; these strands are then wound directly on a rotating spindle through the intermediary of one or more travelers with grooves that ensure the axial distribution of the gathered strands along one or more bobbins by a back and forth movement that is synchronized with the rotation of the spindle; this traveler or these travelers are part of a subassembly called a shed winding, mounted on a mobile support that allows its permanent repositioning during the spooling, in parallel to the axle of the spindle, to allow it to maintain a certain distance between the traveler(s) and the external cylindrical surface of the bobbin(s) whose diameter changes throughout its/their construction.

A first family of bobbin winders is of the manual restarting type, i.e., an operator is in charge of manually restarting the wound packages, and it is possible to wind on the same wound package several strands, up to eight, and even sixteen strands (in which each strand consists of a roving of filaments).

A second family of bobbin winders is of the automatic restarting type. In this ease, the bobbin winder is more complex than those described above, and it comprises, in addition, a circular pirn battery that supports a plurality of spindles (generally at least two), in which each one of the spindles mobile in rotation is adapted to draw and wind at least a successive stacking on each one of the spindles, in which one of the spindles is active while the other one is at rest to allow the discharging of the stacking that has been prepared, in which an automated mechanism coupled to the different actuators of the bobbin winder ensures the passage of at least one roving of filaments from one spindle to the other during the rotation of the circular pirn battery.

With this type of technology, one can obtain several stackings on the same spindle, in which each one of the stackings consists of a single thread of wound strand that has its own characteristics.

On the other hand, with such a stacking, it is not possible to obtain, using bobbin winders with manual restart, a spooling of several threads of optimal quality, i.e., its capacity to be easily unwound, without the presence of loops, interfering knots, and with limitation of friction.

The present invention concerns specifically bobbin winders whose restarting is automated, which do not possess the above-mentioned disadvantages, and which allow the spooling on the same bobbin, separate spooling according to an optimal quality, of at least two threads with different or identical characteristics (notably number of strands per thread, choice of the material forming the strand . . . ).

For this purpose, it is necessary for the precision of the deposition resulting from an axial distribution of the strands that have been wound directly on the rotating spindle to be optimal.

To this end, the method for the manufacture of wound packages comprising a plurality of strands assembled using a bobbin winder comprising a circular pirn battery equipped with a first and a second spindle, in which each one of said first and second spindles are successively either at rest, i.e., in a discharging phase, or moving in rotation, i.e., during a phase of spooling a wound package, is characterized in that

- one separates the strands that come from a spinneret into at least 2 blankets, each one of the blankets forming a roving of strands wound on the same wound package with the help of a traveler that makes it possible to deposit simultaneously on the surface of said wound package the strands that have been so separated, in which said wound package is supported by one of the spindles,
- one proceeds to start the movement of the circular pirn battery in such a way as to switch one of the spindles from its spooling phase to its rest position, while the other spindle passes then from its rest position to its spooling position; during this startup of movement, the traveler is separated from the surface of the wound package,
- during this step of transition between the spindles, one proceeds to a separation of the rovings traveling from the spinneret to the surface of said wound package with the help of a separation device, in which the latter can occupy a first position that allows, on one hand, the separation of the ravings from each other, and on the other hand, maintaining them in a separated position, and a second position in which it does not interfere with the trajectory of the ravings,
- one brings the traveler close to the surface of the wound package, the alternating movement then intercepts the trajectory of each one of the separated rovings in such a way as to enclose each one of the rovings within said traveler and allow the deposition on the surface of the wound package, and one positions the separation device in its second position.

Due to these arrangements and notably to the presence of the separation device, the ravings are constantly preserved and identified during the entire transition phase, namely during the passage from one spooling spindle to the other, thus making it possible to wind on the same wound package at least two rovings in a separate way.

In preferred embodiments of the invention, one can optionally use, in addition, one and/or the other of the following arrangements:

one causes the hooking of the roving within the traveler by a movement of translation of the traveler with respect to said roving, in which the traveler, in a first step, guides the roving by means of a guiding area, then, in a second step, locks it within a locking area, one causes the hooking of the roving within the traveler by a movement of indexation in the position of the traveler with respect to the position of the roving, and the separation device assumes a position in the vicinity of the trajectory of the ravings in such a way that, on the one hand, it intercepts their trajectory and, on the other hand, it pushes back at least a first roving of at least a second roving on both sides of a median plane.

According to another aspect of the invention, the latter relates to a bobbin winder that makes it possible to carry out the above-described method, in which the bobbin winder comprises essentially a frame, which frame comprises a circular pirn battery that can be rotatably moved with respect to the frame, in which said circular pirn battery is [made] of at least two spindles that are each adapted to support at least one wound package, each one of the spindles being rotatable about a first axis that is substantially perpendicular to the diameter of the wound package in such a way as to draw and wind simultaneously at least two rovings in the form of a wound package of separate rovings, and a shed winding device equipped at least with a traveler that makes it possible to deposit on the surface of the wound package the rovings separated from each other, characterized in that it comprises, in addition, a separation device that can occupy a first position in which it allows, on the one hand, the separation from each other of the rovings that travel from a spinneret to the traveler, and on the other hand, maintaining them in a separated position, and a second position in which it does not interfere with the trajectory of the rovings.

In preferred embodiments of the invention, one may use, in addition, one and/or the other of the following arrangements:

the separation device comprises at least one palette provided at the level of one of its sides with at least two edges, edges secant so that they define between them a plane of separation of the passage of at least two rovings, in which each one of the rovings is directed owing to its edges toward immobilization areas that are positioned respectively at the level of the free ends of said edges, the separation device is mounted so it is rotatable with respect to the frame, along an axis that is substantially parallel to the axis of rotation of the spindles, the traveler is mounted in the shed winding device, and it comprises a strand guide of at least two grooves, each groove being adapted to receive one roving, the traveler comprises a strand guide with an overall trapezoidal shape in which two of the sides form curved walls adapted to guide a roving to a wall that projects with respect to one of the two other sides of the strand guide, in which the protruding wall makes it possible to constrain the movement of the roving in a groove located at the foot of said protruding wall, said groove being adapted to immobilize said roving, the traveler comprises a strand guide with an overall trapezoidal shape, one of the sides is provided with a plurality of grooves, each one of the grooves adapted to immobilize a roving, the grooves comprise a recessed part with parallel blank [sic] and a part that tapers towards the outside of said strand guide.

According to another aspect of the invention, the latter relates to a wound package obtained by the above-described method, characterized in that it comprises a plurality of wraps, preferably at least two, in which each of the wraps consists of at least one roving consisting of a material and being separated from one of them by a pitch p.

In the preferred embodiments of the invention, one can optionally use, in addition, one and/or the other of the following arrangements:

the materials forming each one of the wraps are different, the materials forming each one of the wraps are identical, each one of the rovings comprises an identical number of filaments, each one of the rovings comprises a different number of filaments, at least one of the rovings is based on filaments made of commingled glass and thermoplastic polymer strands, for example, polyolefin, polyamide, polyester, thermoplastic polyurethane at least one of the ravings is based on glass filaments, it comprises at least 2 separate wraps, each one of the wraps formed respectively from a roving of 400-4000 glass filaments, preferably 800-1600 glass filaments, and a roving of 200-4000 polypropylene filaments, preferably 600-1600 polypropylene filaments.

Other characteristics and advantages of the invention will become apparent in the following description of one of its embodiments, which is given as a nonlimiting example, in reference to the drawing in the appendix.

Figure 2:
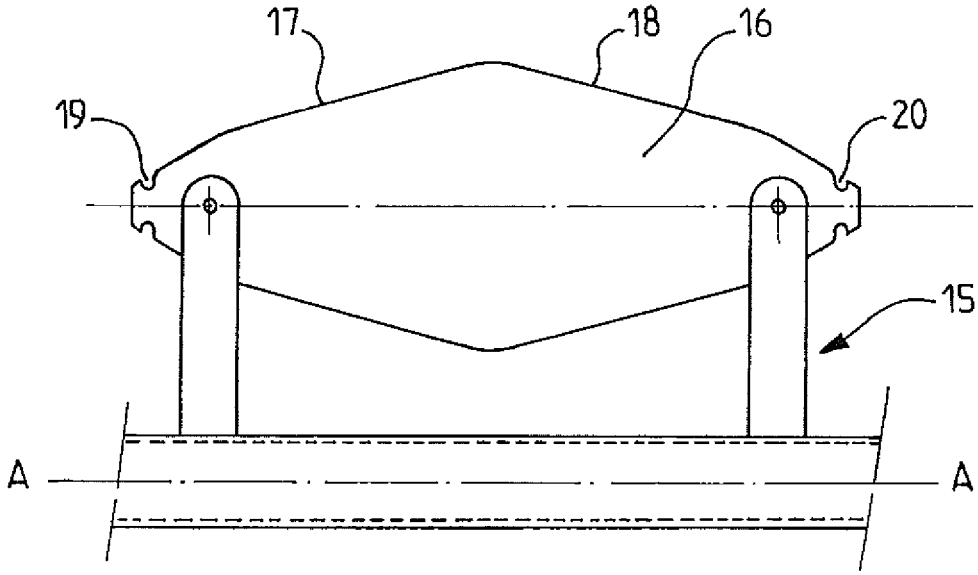
Figure 3:
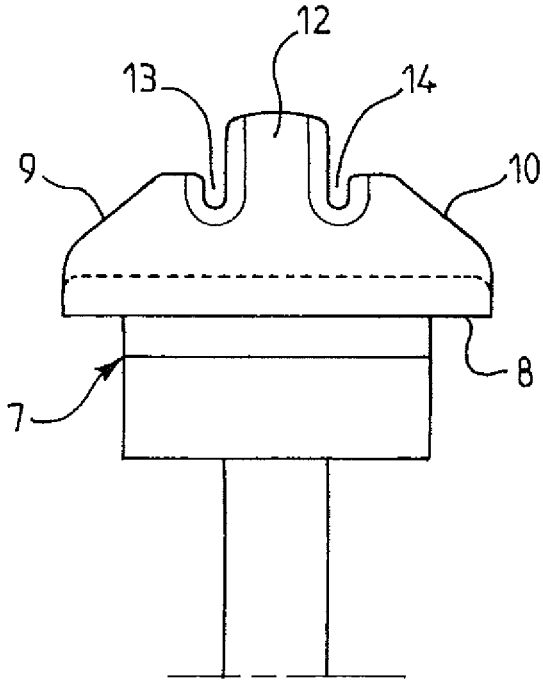

In the drawing:

FIG. 1 is a schematic front view of a bobbin winder according to the invention, FIG. 2 is a front view of the separation device intended for use with 2 rovings, FIG. 3 is a view of a traveler that can be used in combination with the separation device of FIG. 2.

According to a preferred embodiment of a bobbin 1 according to the invention, illustrated in FIG. 1, the bobbin winder comprises a metal frame obtained by a technique of mechanical welding of different elements that have been machined beforehand or are commercially available in the standardized form. This frame comprises essentially a substantially rectangular foundation that rests on feet placed judiciously to correspond to a clearance or to the separation of the forks of a transport palette or of a similar handling device to facilitate the installation of this bobbin winder in a forming position.

On this foundation, a closed structure that is in part covered is assembled, which is intended to receive all the components necessary for the operation of the bobbin winder 1. For this purpose, and in a nonlimiting way, this closed structure designed in the shape of a cabinet is provided with the control and command devices necessary for the different regulations of the different devices, which will be described below in the present description, of hydraulic, electric networks, networks of compressed air and other fluids necessary for the operation of said devices.

On the closed structure, a circular pirn battery 2, which projects laterally, works in cooperation. This circular pirn battery 2 is mounted so it is rotatable about an axis of rotation and it is maintained within one of the walls of the closed structure through the intermediary of a plurality of guidance devices (ball bearing crown, guide rail with ball bearings, for example).

Indeed, this circular pirn battery 2 constitutes a support assembly for spindles 3, 4. In FIG. 1, one notes that the circular pirn battery 2 has two spindles 3, 4, in diametrically opposed positions [if there is only one spindle, it is not possible to carry out the automatic transfer]. In a variant not shown in the figures, one could design a circular pirn battery comprising at least three, four spindles, or even more, depending on the space available and the capacities of the spinneret positioned upstream. The circular pirn battery 2 makes it possible to bring, within the bobbin winder 1, a spindle 3 that has been discharged beforehand, and is equipped with at least one empty sleeve (according to the invention, a sleeve is a support made of plastic material, cardboard or other material, intended to receive the bobbin of strands or the wound package of strands) in the spooling position, and another spindle 4 that arranges its full sleeves in the discharge position by 180° rotations.

Each one of the spindles 3, 4 integrally connected to the circular pirn battery 2 constitutes a rotating assembly adapted to draw and wind the strand 5 on a sleeve that has been introduced beforehand on the spindle. This spooling is carried out along a first axis of rotation substantially parallel to the axis of rotation of the circular pirn battery compared to the structure of the framework.

In FIG. 1, another element appears, which is essential for the production of a bobbin. This is the device for positioning and guiding the strand on the spindle 6. In this example, it is a sliding device movable within a groove, in which the sliding device moves linearly along a second axis that is substantially parallel to the first axis; all of this being mounted within an assembly that may come closer to or move away from the external peripheral surface of the bobbin during the spooling of the latter. This assembly is commonly called a "shed winding device."

Usually, and reference is made to FIG. 3, a shed winding device 6 comprises a device designed as a traveler 7 that is movable linearly within a groove, in which this movable traveler 7 makes it possible to position at least one strand 5 on the spindle 3 or 4 in rotation, the movement conferred by the strand guide 7 consisting essentially of a movement of oscillation or beating only on the length of the bobbin.

To obtain a complete wound package, the traveler 7 is mounted so it is movable with a back and forth movement of translation on a shaft integrally connected to the frame and parallel to the axis of the spindle, in which this second movement of translation thus makes it possible to cover the length of the bobbin.

In a preferred embodiment, the traveler 7 represented in FIG. 3 allows the simultaneous deposition on the surface of the same and single wound package of at least two rovings, in which each one of the rovings consists of a plurality of strands 5, and in which these two strands are separated by a pitch p in the form of, in this case, two nearly touching wraps. This type of wound package with separate wraps nevertheless guarantees an optimal unreeling, without risk of knots and interfering loops.

The traveler 7 has an overall trapezoidal shape, whose base 8 is substantially parallel to the axis of rotation of the wound package.

At the level of its sides, the traveler 7 presents a curved or inclined surface that delimits indeed guidance surfaces 9, 10 that allow, during the displacement of the traveler along a direction substantially parallel to the axis of rotation of the spindle, the interception of the trajectory of a first roving in one displacement direction and of a second roving in the other alternate displacement direction, in which these rovings originate from a spinneret 11 (visible in FIG. 1) placed above the bobbin winder 1, and in which these rovings, owing to the inclined guidance surfaces, are thus directed towards a wall 12 that protrudes with respect to the base 8 of the traveler 7.

This protruding wall constrains each one of the rovings in a retention and immobilization area 13, 14, designed in the shape of a groove (in FIG. 3, two grooves are shown, one for each roving).

Within this groove 13, 14, the roving is free to slide with as little friction as possible; moreover, the material constituting the guidance surface and the grooves is chosen to present locally a high hardness and a coefficient of friction as small as possible so as not to destroy and damage the roving of filaments and notably at the level of its sizing.

The traveler 7, which is substantially trapezoidal, presents walls inclined at the level of its sides 9, 10, as well as the level of the inlet walls of each one of the grooves 13, 14 so as to promote the guidance of the groove towards the groove bottom which presents a parallel axis. In a variant, the inventors have envisaged intercepting the trajectory of the rovings not by an alternating movement of the traveler 7 and they have preferred a movement of position indexing of the traveler 7 with respect to the trajectory of the rovings, in which this movement of position indexing is facilitated by the different control systems for both the position and the speed of a bobbin winder of this type; all the movements of the spindle(es) 3, 4, of the circular pirn battery 2, of the shed winding device 6 and of its traveler 7, and of the separation device 15 which will be discussed below, are controlled by a programmable automation device in charge of controlling and commanding at each time this assembly in view of an optimal spooling of a wound package.

Regardless of the embodiment of the traveler 7, the operation of the latter is combined with that of separation device 15, represented in FIGS. 1 and 2.

This separation device 15 is mounted so it is rotatable with respect to the frame (articulation point marked A) and it travels between a rest position in which the trajectory of the rovings is not deflected by the position of the separation device 15, and a so-called work position in which the separation device 15 intercepts the trajectory of the ravings so as to, on the one hand, spread them or separate them from each other, and on the other hand, to maintain them separate during the transition phase.

The transition phase is defined as the phase during which the rovings that have been wound on the wound package until a full bobbin is obtained from the wound package and from the drawing on a first spindle must switch automatically (i.e., without a human restarting intervention) to another spindle (because of the rotation of the circular pirn battery), in which this second spindle must allow the spooling, the drawing of rovings of filaments on the surface of at least a second wound package.

In this transition phase, it is of crucial importance that the rovings initially wound on the wound package of a first spindle in a separate way if there are two rovings of strands 5 of identical or different material, this corresponds to a bobbin with two wraps) not be mixed or lost during the rotation of the circular pirn battery and that the two rovings can be wound again and drawn in a separate form on a second wound package supported by the second spindle.

For this purpose, the decomposition of the movements is as follows:

During the transition phase, the separation device 15 switches from its rest position to its active position, the rovings of filaments or strands 5 originating from the spinneret 11 that is located above the bobbin winder 1 come in contact with a palette 16 that is integrally connected to the separation device 15.

As one can see in FIG. 2, the palette 16 forms overall a diamond in which one of the axes of symmetry is positioned in such a way that it separates, along a median plane, the trajectory of the ravings, each one of the rovings passing on both sides of this median plane.

Taking into account the inclined faces 17, 18 of the palette 16, each one of the rovings in contact with this phase is directed towards the free ends of the diamond toward a retention area 19, 20 or an area with grooves adapted to receive with as little friction as possible each one of the rovings, in which the ravings cannot escape from these areas for the entire duration of the transition phase.

When each one of the rovings is held in its retention area 19, 20, the shed winding device moves away from the wound package surface or the full bobbin, releasing the traveler 7 from its corresponding roving, the circular pirn battery 2 carries out a movement of rotation in such a way as to arrange the second spindle 3 or 4 so it is ready to wind and draw a second wound package under conditions similar to the first wound package.

When the second spindle 3 or 4 is ready to be wound, the shed winding device 6 comes closer to the surface of the wound package, the ravings (still held in their respective retention area 19, 20 of the palette 16) graze the surface of the wound package (they remain under tension due to the position of the first spindle), the separation device 15 is positioned in its rest position, releasing the rovings from their respective retention area 19, 20.

The rovings then intercept the alternating movement of the traveler 7, as explained above. When each one of the grooves 13, 14 of the traveler 7 is engaged with its respective roving, the spooling of the wound package can be initialized, and the bobbins obtained from the bobbin winder that functions according to the modalities of the above-described procedure differ significantly from the prior art:

Indeed, it is possible to wind on the same spindle axle and on at least one same wound package (notably two juxtaposed wound packages) several rovings (at least two in the examples), in which each one of the rovings can consist of a number n and n' of identical or different filaments, of the same material or of different materials, in which these materials are chosen from those for technical use, such as, for example, those based on glass, thermoplastics (notably polypropylene).

These wound packages have the capacity of being unreeled, although none of the wraps is separated by a pitch p, without risk of knots or interfering loops forming.

An example of a wound package based on "Twintex"®, which is a registered trade name of a commingled strand of glass and thermoplastic, is given below.

This wound package comprises at least 2 separate wraps, in which each one of the wraps is formed respectively from a roving of 400-4000 glass filaments, preferably 800-1600 glass filaments, and a roving of 200-4000 polypropylene filaments, preferably 600-1600 polypropylene filaments.

Indeed, it may be advantageous to obtain, on one wound package, at least two separate wraps as a function of the intended applications

- Glass and thermoplastic: to produce composite fabrics resistant to tearing or piercing
- Commingled product and glass: for applications of ballistic-reinforced thermoplastic plates with controlled delamination, using fabrics or thermoformed unidirectional fabrics
- Commingled product and thermoplastic for mats with low glass contents.

For these applications, no solution was found in the prior art, which discloses only wound packages with separate wraps of identical type and optionally different titer.

The invention claimed is:

1. A method for the manufacture of wound packages comprising a plurality of strands assembled with the help of a bobbin winder comprising a circular pirn battery equipped with at least a first spindle and a second spindle, in which each one of said first and second spindles is successively either at rest during a discharging phase or rotatable during a phase of spooling a wound package, the method comprising:

separating the strands that come from a spinneret into at least two blankets, each one of the blankets forming a roving of strands wound on the same wound package with the help of a shed winding device equipped with a traveler making it possible to deposit simultaneously on the surface of said wound package the strands that have been so separated, in which said wound package is supported by one of the spindles;

starting movement of the circular pirn battery to switch one of the spindles from its spooling phase to its rest position, while the other spindle passes then from its rest position to its spooling position, wherein the traveler is separated from the surface of the wound package during startup of movement of the circular pirn battery;

during the step of transitioning between the spindles, separating the rovings traveling from the spinneret to the surface of said wound package with the help of a separation device, wherein the separation device can occupy a first position in which it both separates the rovings from each other and maintains them in a separated position, and a second position in which it does not interfere with the trajectory of the rovings;

bringing the traveler close to the surface of the wound package; and positioning the separation device in its second position, wherein the traveler intercepts the trajectory of each one of the separated rovings so as to enclose each one of the rovings within said traveler and allow the deposition of the surface of the wound package.

2. The method according to claim 1, further comprising hooking the roving within the traveler by a translation movement of the traveler with respect to said roving, the latter guiding, in a first step, the roving due to a guidance area, and then in a second step, locking it within a locking area.

3. The method according to claim 1, further comprising hooking the roving within the traveler by a movement of position indexing of the strand guide with respect to the position of the roving.

4. The method according to claim 1, wherein the separation device is positioned in the vicinity of the trajectory of the rovings in such a way as to both intercept their trajectory and separate the first roving and the second roving on opposite sides of a median plane.

5. A spooling device for carrying out the method according to claim 1, the spooling device comprising a frame, in which this frame comprises a circular pirn battery that can be moved in rotation with respect to the frame, in which said circular pirn battery is made of at least two spindles that are each adapted to support at least one wound package, each one of the spindles rotatable about a first axis substantially perpendicular to the diameter of the wound package in such a way as to draw and wind simultaneously at least two rovings in the form of a wound package of separate rovings, and a shed winding device equipped at least with a traveler, which makes it possible to deposit on the surface of the wound package the rovings separated from each other, and further comprising a separation device that can occupy a first position in which it both allows for the separation from each other of the rovings that travel from a spinneret to the traveler and maintains them in a separated position, and a second position in which it does not interfere with the trajectory of the rovings.

6. The spooling device according to claim 5, wherein the separation device comprises at least one palette provided at the level of one of its sides with at least two edges, in which these edges are secant in such a way as to define between them a separation plane of the passage of at least two rovings, each one of the rovings being directed owing to these edges towards immobilization areas positioned respectively at the level of the free ends of said edges.

7. The spooling device according to claim 5, wherein the separation device is mounted so it is rotatably movable with respect to the frame, along an axis that is substantially parallel to the axis of rotation of the spindles.

8. The spooling device according to claim 5, wherein the traveler is mounted in the shed winding device and comprises at least two grooves, each one of the grooves adapted to receive a roving.

9. The spooling device according to claim 8, wherein the grooves comprise a recessed part with parallel blanks and a part that tapers towards the outside of said strand guide.

10. The spooling device according to claim 5, wherein the traveler comprises a strand guide of overall trapezoidal shape, of which two of the sides form curved walls adapted to guide the roving to a wall protruding with respect to one of the two other sides of the strand guide, in which this protruding wall makes it possible to constrain the displacement of the roving in a groove located at the foot of said protruding wall, said groove being adapted to immobilize said roving.

* * * * *